United States Patent [19]

Klessig

[11] 4,024,589

[45] May 24, 1977

[54] SIPHON FLUSH VALVE

[75] Inventor: Clarence Edward Klessig, Sheboygan, Wis.

[73] Assignee: Kohler Co., Kohler, Wis.

[22] Filed: Dec. 22, 1975

[21] Appl. No.: 642,948

[52] U.S. Cl. ..... 4/42; 4/44; 4/67 A

[51] Int. Cl.[2] ..... E03D 1/04; E03D 1/06

[58] Field of Search ..... 4/1, 10, 44, 45, 46, 4/47, 42, 48, 49, 50, 52, 53, 56, 67 A, 67 R

[56] References Cited

UNITED STATES PATENTS

| | | | |
|---|---|---|---|
| 665,825 | 1/1901 | Carroll | 4/44 |
| 990,132 | 4/1911 | Hodgkins | 4/44 |
| 1,361,814 | 12/1920 | Bosworth | 4/44 |
| 1,556,100 | 10/1925 | Gondolf | 4/44 |
| 3,913,149 | 10/1975 | Brinton | 4/67 A |

FOREIGN PATENTS OR APPLICATIONS

| | | | |
|---|---|---|---|
| 368,546 | 3/1932 | United Kingdom | 4/47 |
| 647,939 | 12/1950 | United Kingdom | 4/47 |
| 1,150,746 | 4/1969 | United Kingdom | 4/46 |

*Primary Examiner*—Henry K. Artis
*Attorney, Agent, or Firm*—Quarles & Brady

[57] ABSTRACT

A flush valve of the siphon type with a supply jet feeding into the upleg is provided with a flap-float valve that is responsive to water level and serves to divert the supply flow to refill the tank after completion of a flushing action. In the preferred embodiment, the float of the flap-float valve is disposed in a chamber which insures that it will operate only after full completion of the flushing action, slide means are provided on the chamber for adjusting the amount of water used, there is an overflow chamber built onto the downleg to provide the usual water seal, and the valve includes means to provide a rim wash.

8 Claims, 5 Drawing Figures

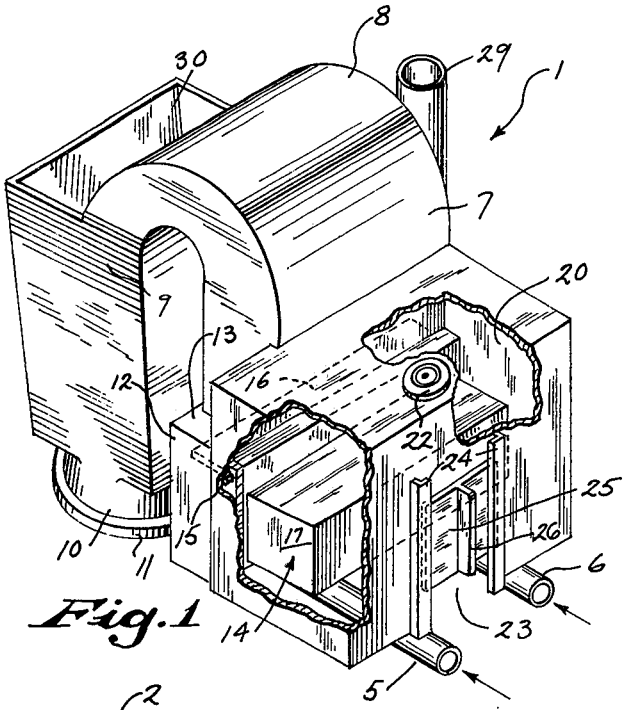
Fig. 1
Fig. 3
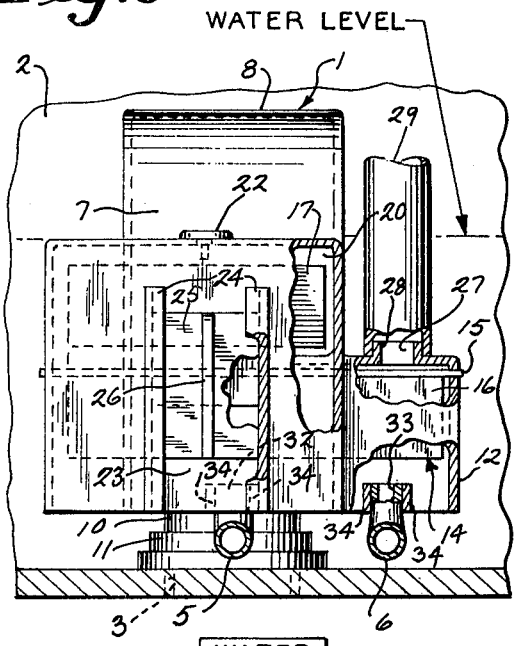
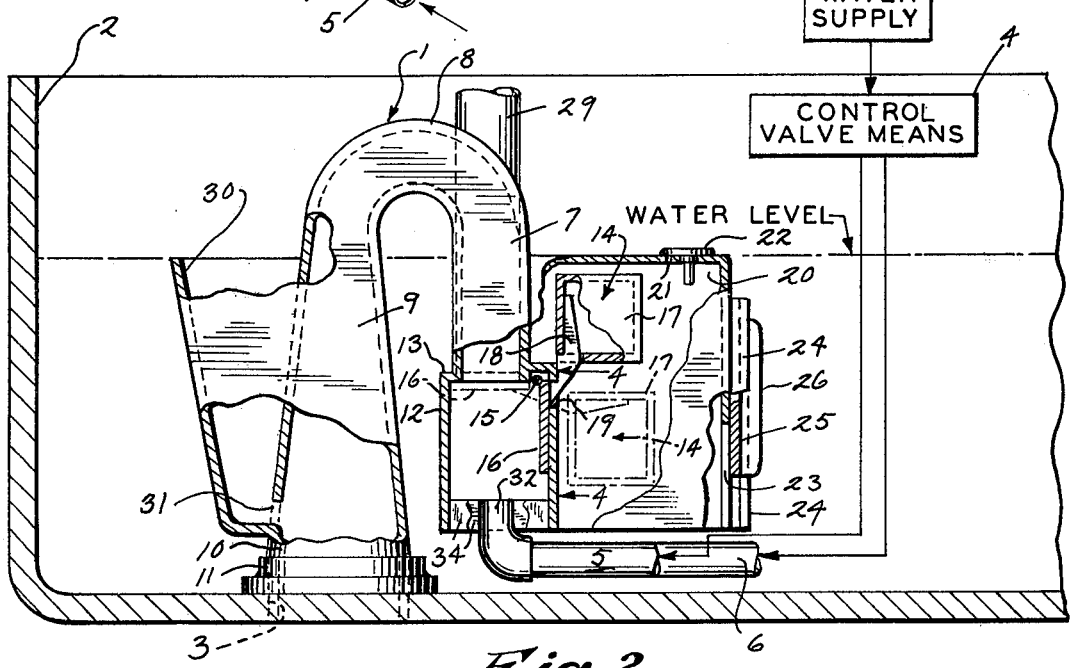
Fig. 2
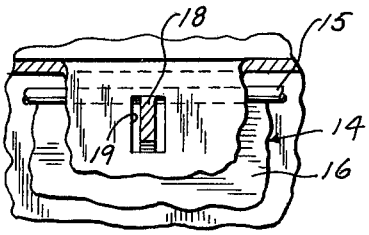
Fig. 4
Fig. 5
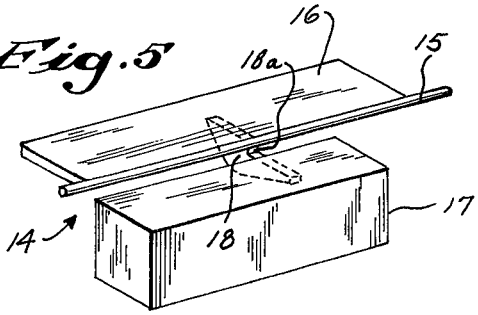

SIPHON FLUSH VALVE

BACKGROUND OF THE INVENTION

There is a continuing demand for improvements in water closets, and one area of particular concern is the amount of water used during each flushing cycle. There are already laws or regulations in various areas of the country setting maximum water usage limits, and it is expected that such requirements will increase and become ever more strict. One area where improvements in the typical water closet can be made is the flush valve. Most water closets in use today have the conventional type of ball flush valve where the valve is lifted by a chain or other linkage with the operating handle and then drops back onto its seat as the water level in the tank lowers. While most such arrangements are generally satisfactory, every homeowner is aware of the problems that arise when the ball valve wears, fails to seat properly, etc. More importantly, however, such valves are not particularly efficient from the standpoint of providing adequate flushing with minimum water usage, one of the problems in this regard being that the flow rate through the tank outlet tends to decrease as the water level in the tank lowers. Conventional flush valves present particular problems in so-called "one piece" water closets where the tank is lower so there is less of a pressure head.

The foregoing problems can be solved by the use of a siphon-type flush valve with a water supply jet that feeds into the upleg to develop a siphonic action that quickly empties the water from the tank into the bowl. Valves of this type are not new as such - see for example U.S. Pat. Nos. 952,101; 1,259,226; 1,593,336; 2,073,835; 2,412,691; 3,750,195 and 3,773,063 - but known valves of this type are not fully satisfactory from all standpoints. It is, for example, desirable to have the supply jet operative during the entire time the tank is emptying and then use the same jet to supply water for refill, but is is difficult to provide simple and reliable means for diverting the flow from the upleg toward the tank at the conclusion of the flushing portion of the cycle.

Another problem is providing a satisfactory rim wash, again using a minimum quantity of water. There are arrangements in which a fresh water jet feeds the rim and also aspirates tank water toward the rim to provide a better washing action — see for example U.S. Pat. No. 3,172,128 — but, again, it is desirable to be able to divert the rim flow to refill after the flushing part of the cycle has been completed, and it is difficult to provide simple and reliable means for doing so.

SUMMARY OF THE INVENTION

The general object of this invention is to provide a siphon type flush valve in which a flap-float valve is used to divert a water supply jet, this arrangement being relatively simple yet highly effective and reliable. The preferred embodiment of the invention includes a number of other important features. One is a chamber for the flap-float valve that, in effect, insures that the flap will not move to its diverting position until the tank has been completely emptied to the extent desired and that incorporates means to adjust the quantity of water removed from the tank for each flushing cycle. Another is the provision of an integral overflow chamber which, in combination with a timed control valve, provides the necessary water seal in the bowl. Still another feature is the provision of a secondary supply jet that feeds toward the rim and that is also controlled by the flap-float valve.

The preferred embodiment of the invention incorporates and provides the noted features and advantages and others that will appear from the description to follow, is highly reliable and efficient, is adaptable to a wide variety of closet designs, and is still relatively simple and inexpensive.

BRIEF DESCRIPTION OF THE DRAWINGS

FIG. 1 is a view in perspective, partially broken away, of a flush valve constituting a preferred embodiment of the invention;

FIG. 2 is a side view in elevation, with parts shown broken away and in cross section and an alternative position of the flap-float valve shown in broken lines, showing the valve of FIG. 1 in place in a closet tank;

FIG. 3 is an end view in elevation, with parts shown broken away and in cross section, of the valve as seen in FIG. 2;

FIG. 4 is an enlarged view partly in section taken along lines 4—4 of FIG. 2; and FIG. 5 is a view in perspective of the flap-float valve forming a part of the flush valve of FIGS. 1–3.

DESCRIPTION OF THE PREFERRED EMBODIMENT

In the drawing, the flush valve is designated generally by the reference numeral 1. In use, it is supported on the bottom wall of a conventional tank 2 provided with the usual outlet opening 3.

A control valve means 4, preferably disposed in the tank 2 above the water level, is connected to a pressurized water supply line and has a main outlet line 5 and a supplemental outlet line 6 leading toward the flush valve 1. The control valve means 4 is preferably a manually actuated, timed valve which delivers water from the supply for a predetermined period of time after actuation. The valve means 4 is not shown in detail because such valves are well known to those skilled in the art; U.S. Pat. Nos. 1,521,355; 1,657,817; 2,169,452; and 3,245,650 disclosed representative timed valves that might be used with the flush valve 1 and others are commercially available. The term "control valve means" as used herein is intended to include any type of valve that is actuatable to deliver a predetermined quantity of water from a water supply, whether the quantity be controlled by timing, water level, or otherwise.

The flush valve 1 is preferably formed of a suitably rigid molded plastic material. In the drawing, the valve body is shown as being essentially of a onepiece construction, but it will be obvious that, particularly for molded valves, it may be formed in several pieces suitably attached together in ways well known in the art. Other materials and methods of construction may obviously be substituted.

The valve 1 is essentially in the shape of a siphon of generally rectangular cross section, and comprises an upleg 7, an upper loop 8, and a downleg 9. The downleg 9 is provided at its bottom end with a circular extension 10, and a ring adapter 11, which is fitted to the extension 10 and surrounds the outlet 3 so that the downleg 9 is in communication with the bowl. Two opposing sides of the downleg 9 are flared and the other two sides are narrowed to maintain a substantially uniform cross sectional area in the downleg as it changes shape to meet the circular extension 10.

The bottom portion of the upleg 7 is enlarged to define a generally rectangular chamber 12 at the top of which is a perimetrical flange 13 that entirely surrounds the upleg 7 and serves as a seat for a diverting flap as will be described.

The flap-float valve is designated generally by the reference numeral 14 and is seen most clearly in FIG. 5. It includes a shaft 15 that is rotatably journaled in opposite openings formed in the side walls of the chamber 12 at its upper right corner as seen in FIG. 2, and a flap 16 which is connected directly to the shaft 15 and a float 17 that is connected by an arm 18 to the shaft 15 and flap 16 so that neither the flap 16 nor the float 17 is rotatable with respect to the shaft or each other. The flap 16 is rectangular and is disposed within the chamber 12 where it is pivotable from a retracted position — seen in full lines in FIG. 2 — where it is against one wall of the chamber 12 and a horizontal diverting position — seen in broken lines in FIG. 2 — where it is seated against the flange 13 to seal off the upleg 7. The float 17 is a hollow, generally rectangular chamber that is disposed outside the chamber 12.

The arm 18 is a rigid stepped member having an upper horizontal portion, a riser 18*a* and a lower horizontal portion. The upper horizontal portion of the arm 18 is attached to the bottom side of the flap 16, and the lower horizontal portion of the arm 18 passes through the side wall of the float 17 and is attached at a point intermediate its length to the underside of the top wall of the float 17. The point at which the arm 18 passes through the side wall of the float 17 is sealed in a leakproof manner to prevent water from entering the float 17 and interfering with its function.

As seen in FIG. 5, the riser 18*a* is of sufficient height and the float 17 is spaced from the riser 18*a* a sufficient distance so that the wall of the chamber 12 will not interfere with the float 17 rising to its maximum height as shown in FIG. 2. In order to accommodate the free movement of the arm 18, the wall of the chamber 12 is provided with a passageway 19 (seen only in FIG. 4). The passageway 19 is preferably of the minimum size which will not interfere with the free movement of the arm 18 and which will provide only minimal communication between the chamber 12 and the outside.

Referring again to FIG. 2, the float is pivotable between an upper, retracted position corresponding to the retracted position of the flap 16 and a lower, diverting position corresponding to the diverting position of the flap.

The float 17 is disposed in generally rectangular float chamber 20 that is attached to but not in substantial communication with the upleg 7 and the chamber 12. A bleed hole 21 is cut through the upper wall of the float chamber 20, and a conventional mushroom-type check valve 22 has its center post section fixed in the upper wall of the chamber 20 and its peripheral valve portion overlaying the bleed hole 21 from above. The valve 22 is preferably a soft, resilient rubber; and it is easily movable upwardly to allow air to exit from the chamber 20 but serves as a seal to prevent the entry of air or water into the chamber 20 through the bleed hole 21.

The wall of the chamber 20 opposite the uplet 7 is cut out to define a rectangular adjustment slot 23, and L-shaped strips 24 are fixed to the outer surface of the chamber wall alongside the veritcal edges of the slot 23 in facing relationship to define a slideway. A generally rectangular shutter-like adjustment member 25 is vertically slidable in the slideway and is preferably provided on its outer surface with a vane 26 which allows it to be moved manually. If desired, the slot 23 may be replaced by a series of openings which may be exposed or covered by the shutter-like adjustment member 25.

As can be seen in FIG. 3, the flap chamber 12 extends laterally beyond one side of the upleg 7, and the upper wall of this portion is provided with a circular outlet opening 27 surrounded on top by an upstanding annular flange 28 that is received tightly in the bottom end of a hose 29 that leads to the rim of the closet (not shown).

An overflow chamber 30 of hopper-like configuration is formed alongside the downleg 9 and communicates therewith through a bottom opening 31.

A main jet fitting 32 is disposed in alignment with the upleg 7 and a supplemental jet fitting 33 is disposed in alignment with the outlet 27. Both fittings are elbow shaped with vertical jet legs of restricted internal diameter held in place between cross pieces 34 secured to and extending between the walls of the chamber 12 and horizontally extending legs. The jet 32 is connected to the main outlet line 5 and jet 33 is connected to the outlet line 6 by suitable hoses or other conduits.

The full line showing of FIG. 2 indicates the position of the flap-float valve 14 prior to the initiation of a flushing action. The water level in the tank 2 is at the indicated line and the float chamber 20 is full of water as the result of which the float 17 is held in its upper, retracted position, which means that the flap 16 is also held in its retracted position against the wall of the chamber 12. That portion of the upleg 7 above the water level is filled with air, as are the loop 8 and downleg 9. A flushing action is initiated by actuating the control valve means 4 as the result of which water under pressure is delivered through the jets 32 and 33. This, with the pressure head in the tank, pushes water up the upleg 7, around the loop 8 and down the leg 9, sweeping the air out and quickly establishing a siphonic action that empties the water in the tank through the outlet 3 and into the bowl. Water continues to be delivered through the jets 32 and33 during the entire emptying cycle; and this is advantageous in that the flow rate through the outlet 3 remains relatively uniform, as opposed to conventional ball flush valve arrangements in which the rate of flow tends to decrease as the pressure head is reduced by lowering of the water level.

As water is being moved up the upleg 7, it is also being moved upwardly through the rim outlet 27 and hose 29 to provide a suitable rim wash. The water for the rim wash is supplied primarily by the supplemental jet 33, but there is some aspiration of tank water and flow from the jet 32 since the two jets are not in separate chambers. The two jet arrangement shown is preferred, but the same result might conceivably be accomplished using a single jet.

As the water level lowers, the float chamber 20 remains full of water since bleed hole 21 is sealed and there is no way for air to enter. Once the water level reaches the bottom edge of the chamber 20, however, it will empty and air will enter at which time the float 17 and flap 16 will then move to their diverting positions shown in broken lines in FIG. 2. In this position, the upleg 7 and outlet 27 are both sealed off (note above that flap seals outlet) and further flow from the jets 32 and 33 is diverted into the tank for refill. The float chamber 20 is very advantageous in insuring that the flap-float valve is held in retracted position until the emptying phase of the cycle has been completed; without the chamber the flap-float valve 4 would move through a series of intermediate positions and could be caught by the flow from the jets and moved to diverting position prior to the desired time.

The control valve means 4 is set so that water continues to be delivered until the tank is refilled to the desired level. Actually, the setting is such that more water is delivered than would be necessary to reach the indicated level and the excess goes into the overflow chamber 30 and through the opening 31 and into the bowl to provide the usual seal. The overflow chamber 30 actually controls the level of water in the tank and, if desired, a separate supply of water could be employed to provide the seal.

The amount of water used during each flushing action can be controlled by means of the shutter 25. If it is raised from the position shown in the drawing, air can enter the chamber 20 at an earlier point after less water has been delivered to the bowl and rim; the setting of the control valve means will, of course, have to be changed to correspond to the setting of the shutter 25. This method of controlling the amount of water used is quite different than ordinary methods which simply involve reducing the amount of water put into the tank. With this invention, the same amount of water is in the tank prior to each flushing action, and it is the amount of water used that is controlled. This is advantageous in that there in no variation in the pressure head and hence performance is uniform.

While the embodiment shown and described herein is preferred and offers all of the noted advantages, it will be apparent that modifications in structure and arrangement are possible without departure from the spirit of the invention. The invention is not, therefore, intended to be limited by the showing or description herein, or in any other manner, except insofar as may specifically be required.

I claim:

1. A siphon flush valve for use in a water closet tank, said valve comprising: a siphon portion having an upleg open at its bottom end, a downleg that is connectible to a tank outlet, and a counnecting loop; a flap-float valve associated with the upleg; a flap chamber located in an enlarged portion of the bottom end of the upleg in which the flap portion of the flap-float valve is positioned; and a separate float chamber in which the float portion of the flap-float valve is positioned, the float chamber being provided at its bottom with an opening and provided at its top with a check valve that permits air to leave the chamber when the float chamber is filling with water but prevents air from entering the chamber when the tank is emptying, so that once the chamber is filled with water it does not empty until the water level in the tank falls below the bottom opening of the chamber at which time water leaves the chamber and the float falls swinging the flap from a retracted to an actuated position in which it blocks the upleg.

2. The siphon flush valve of claim 1 in which a side wall of the float chamber is provided with an opening and an adjustable shutter-like member for the opening so that the opening can be exposed to permit water to leave the float chamber before the level of the water in the tank has reached the bottom of the float chamber.

3. The siphon flush valve of claim 1, wherein: the flap chamber is provided at its top with a perimetrical ledge that surrounds the portion of the upleg that is above the chamber; and the flap seats on the perimetrical ledge.

4. A valve according to claim 3 wherein the flap chamber includes a rim feed portion that extends laterally from the upleg; and there is a rim feed outlet leading from the rim feed portion; and the flap in its actuated position extends across the entire chamber thus closing off both the upleg and the rim feed outlet.

5. A unitary one-piece siphon flush valve comprising:

a. a siphon having an upleg open at its bottom, a downleg that is connectible to a tank outlet, and a connecting loop;

b. a flap-float valve associated with said upleg, said flap-float valve including a flap that is associated with the upleg and movable between a retracted position and an actuated position in which it blocks the upleg;

c. a flap chamber in an enlarged bottom portion of the upleg, said chamber having a perimetrical ledge at the top that surrounds the portion of the upleg that is above the chamber and provides a seat for the flap;

d. a float chamber, said float chamber being adjacent to, but not in substantial communication with the upleg, the upper wall of said float chamber being provided with a check valve that permits air to leave said chamber when the chamber is filling with water but prevents air form entering said chamber when the tank is emptying, said float valve being further provided with a bottom opening which allows water to enter and leave said chamber, said float chamber being effective to prevent the float from falling and the flap from swinging to seat upon the perimetrical ledge until the water level in the tank has dropped below the bottom opening of the float chamber; and e. an overflow chamber positioned adjacent to and integral with the downleg of the siphon, said overflow chamber being open at its upper end and communicating with the downleg of the siphon only at its lower end.

6. The siphon flush valve of claim 5 in which a side wall of the float chamber is provided with an opening and means for exposing said opening so that water can leave the float chamber before the tank water level has dropped below the bottom opening of the float chamber.

7. A siphon flush valve for use within the water tank of a toilet, said valve comprising a siphon having an upleg open at its bottom end, a downleg that is connectible to the tank outlet and a connecting loop; a flap positioned in said upleg adjacent the bottom, said flap being removable from a retracted to an actuated position in which it closes the upleg, a float rigidly attached to said flap so that when said float is at its maximum height the flap is retracted and when the float is at its minimum height the flap is actuated, said float being positioned in a separate float chamber having minimal communication with the upleg, said chamber being open at the bottom and closed at the top except for a check valve which permits air to leave said chamber when the chamber is filling with water but prevents air from entering said chamber when the tank is emptying, said chamber being effective to maintain the float at its maximum height until the level of water in the tank has fallen below the open bottom of the float chamber at which time water leaves said chamber and the float falls moving the flap to its actuated position interrupting flow through the upleg.

8. The siphon flush valve of claim 7 in which the float chamber is provided with an opening and means for adjustably exposing said opening to allow water to leave the float chamber through the opening even though the water level in the tank has not reached the open bottom of the float chamber, said means cooperating with the flap-float valve to control the amount of water removed from the toilet tank.

* * * * *